US009109766B1

(12) United States Patent
Ball et al.

(10) Patent No.: US 9,109,766 B1
(45) Date of Patent: Aug. 18, 2015

(54) UNDERWATER LIGHTING SYSTEM

(71) Applicants: Bradley A. Ball, St. Petersburg, FL (US); Kevin P. Ahearn, Sarasota, FL (US)

(72) Inventors: Bradley A. Ball, St. Petersburg, FL (US); Kevin P. Ahearn, Sarasota, FL (US)

( * ) Notice: Subject to any disclaimer, the term of this patent is extended or adjusted under 35 U.S.C. 154(b) by 0 days.

(21) Appl. No.: 14/188,716

(22) Filed: Feb. 25, 2014

(51) Int. Cl.
*F21S 8/00* (2006.01)

(52) U.S. Cl.
CPC ..... *F21S 8/00* (2013.01)

(58) Field of Classification Search
CPC ..... F21S 8/00
USPC ..... 250/504 R, 461.1, 526; 362/101, 267
See application file for complete search history.

(56) References Cited

U.S. PATENT DOCUMENTS

| | | | | | |
|---|---|---|---|---|---|
| 3,949,213 | A * | 4/1976 | Paitchell | 362/101 |
| 4,450,511 | A * | 5/1984 | Micha | 362/267 |
| 5,349,505 | A * | 9/1994 | Poppenheimer | 362/101 |
| 5,800,041 | A * | 9/1998 | Poggi | 362/101 |
| 5,842,771 | A * | 12/1998 | Thrasher et al. | 362/101 |
| 6,315,424 | B1 * | 11/2001 | Hui | 362/22 |
| 6,315,429 | B1 * | 11/2001 | Grandolfo | 362/158 |
| 6,633,110 | B2 * | 10/2003 | McGuire et al. | 313/113 |
| 7,008,081 | B2 * | 3/2006 | Lunt | 362/267 |
| 7,591,564 | B1 * | 9/2009 | Ball et al. | 362/101 |
| 8,123,372 | B1 * | 2/2012 | Ball et al. | 362/101 |
| 8,246,189 | B2 * | 8/2012 | Muller et al. | 362/101 |
| D689,221 | S * | 9/2013 | Isaac | D26/24 |
| 2002/0178641 | A1 * | 12/2002 | Kent | 43/17.5 |
| 2005/0024876 | A1 * | 2/2005 | Oppenheimer et al. | 362/267 |
| 2005/0168970 | A1 * | 8/2005 | Mateescu et al. | 362/101 |
| 2005/0174774 | A1 * | 8/2005 | Lunt | 362/267 |
| 2005/0225086 | A1 * | 10/2005 | Landvik | 285/391 |

* cited by examiner

*Primary Examiner* — David A Vanore

(57) ABSTRACT

A housing has an open top and closed bottom. The housing has a cylindrical side wall. In this manner a chamber is formed interiorly. The housing includes an annular lower flange. The lower flange extends outwardly from the top. A lens is in an upwardly extending hemispherical configuration. The lens has an annular upper flange. The upper flange is in mating contact with the lower flange. A socket assembly including a base is provided within the chamber. The base has projections. The projections terminate in spaced light sockets. A reflector is in a downwardly extending hemispherical configuration within the chamber. A bulb has opposed ends. The opposed ends are removably received within the light sockets. Additional components within the housing include an electrical ballast and weights holing down the electrical ballast and the entire housing.

8 Claims, 3 Drawing Sheets

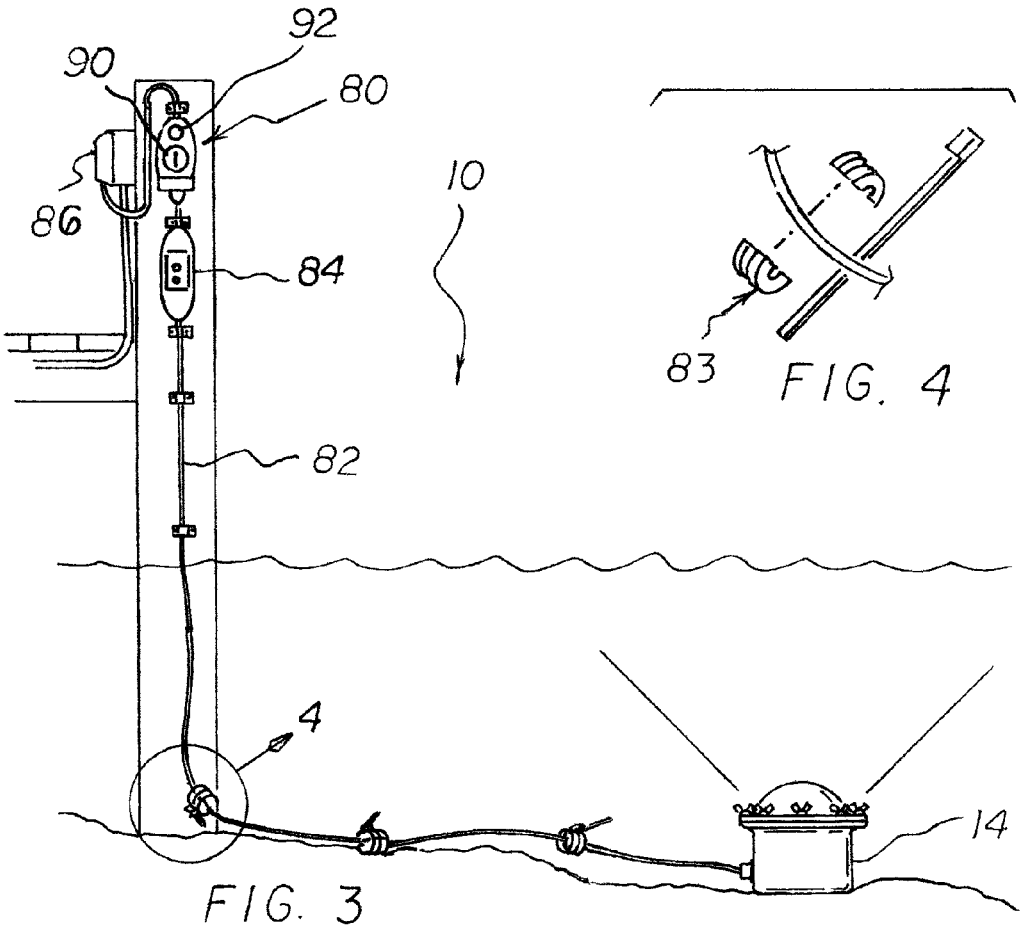
FIG. 3
FIG. 4
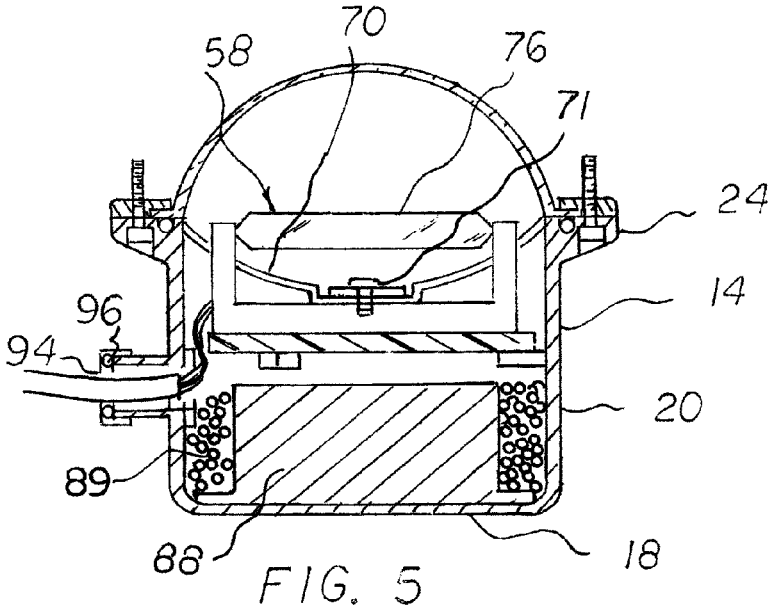
FIG. 5

UNDERWATER LIGHTING SYSTEM

RELATED APPLICATIONS

The present application is an improvement over our prior applications now U.S. Pat. No. 7,591,564 issued Sep. 11, 2009 and U.S. Pat. No. 8,123,372 issued Feb. 26, 2012, the subject matter of which patents is incorporated herein by reference.

BACKGROUND OF THE INVENTION

1. Field of the Invention

The present invention relates to an underwater lighting system and more particularly pertains to illuminating a large body of water in a safe, convenient and economical manner.

2. Description of the Prior Art

The use of lighting systems of known designs and configurations is known in the prior art. More specifically, lighting systems of known designs and configurations previously devised and utilized for the purpose of providing illumination through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,031,544 issued Jun. 21, 1977 to Lapetina relates to a Sonar/Television System for use in Underwater Exploration. U.S. Pat. No. 6,315,429 issued Nov. 13, 2001 to Grandolfo relates to an Underwater Lighting System. U.S. Pat. No. 6,633,110 issued Oct. 14, 2003 to McGuire relates to an Underwater Lamp. Lastly, U.S. Pat. No. 7,008,081 issued Mar. 7, 2006 to Lunt relates to an Underwater Light.

While these devices fulfill their respective, particular objectives and requirements, the aforementioned patents do not describe an underwater lighting system that allows for illuminating a large body of water in a safe, convenient and economical manner.

In this respect, the underwater lighting system according to the present invention substantially departs from the conventional concepts and designs of the prior art, and in doing so provides an apparatus primarily developed for the purpose of illuminating a large body of water in a safe, convenient and economical manner.

Therefore, it can be appreciated that there exists a continuing need for a new and improved underwater lighting system which can be used for illuminating a large body of water in a safe, convenient and economical manner. In this regard, the present invention substantially fulfills this need.

SUMMARY OF THE INVENTION

In view of the disadvantages inherent in the known types of lighting systems of known designs and configurations now present in the prior art, the present invention provides an improved underwater lighting system. As such, the general purpose of the present invention, which will be described subsequently in greater detail, is to provide a new and improved underwater lighting system and method which has all the advantages of the prior art and none of the disadvantages.

To attain this, the present invention essentially comprises an underwater lighting system. First provided is a housing having an open top and closed bottom. The housing has a cylindrical side wall. In this manner a chamber is formed interiorly. The housing includes an annular lower flange. The lower flange extends outwardly from the top. A lens is in an upwardly extending hemispherical configuration. The lens has an annular upper flange. The upper flange is in mating contact with the lower flange. A socket assembly including a base is provided within the chamber. The base has projections. The projections terminate in spaced light sockets. A reflector is in a downwardly extending hemispherical configuration within the chamber. A bulb has opposed ends. The opposed ends are removably received within the light sockets. Additional components within the housing include an electrical ballast and weights holding down the electrical ballast and the entire housing.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved underwater lighting system which has all of the advantages of the prior art lighting systems of known designs and configurations and none of the disadvantages.

It is another object of the present invention to provide a new and improved underwater lighting system which may be easily and efficiently manufactured and marketed.

It is further object of the present invention to provide a new and improved underwater lighting system which is of durable and reliable constructions.

An even further object of the present invention is to provide a new and improved underwater lighting system which is susceptible of a low cost of manufacture with regard to both materials and labor, and which accordingly is then susceptible of low prices of sale to the consuming public, thereby making such underwater lighting system economically available to the buying public.

Lastly, it is an object of the present invention is to provide an underwater lighting system for illuminating a large body of water in a safe, convenient and economical manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated not only the primary and preferred embodiment of the present invention but also an alternate embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevational view of an entire underwater lamp system.

FIG. 4 is an enlarged exploded illustration of the weighting components in Circle 4 in FIG. 3.

FIG. 5 is a cross sectional view of the system taken along line 5-5 of FIG. 2.

The same reference numerals refer to the same parts throughout the various Figures including the primary, preferred embodiment of the invention.

DESCRIPTION OF THE PREFERRED EMBODIMENT

Figure 1:
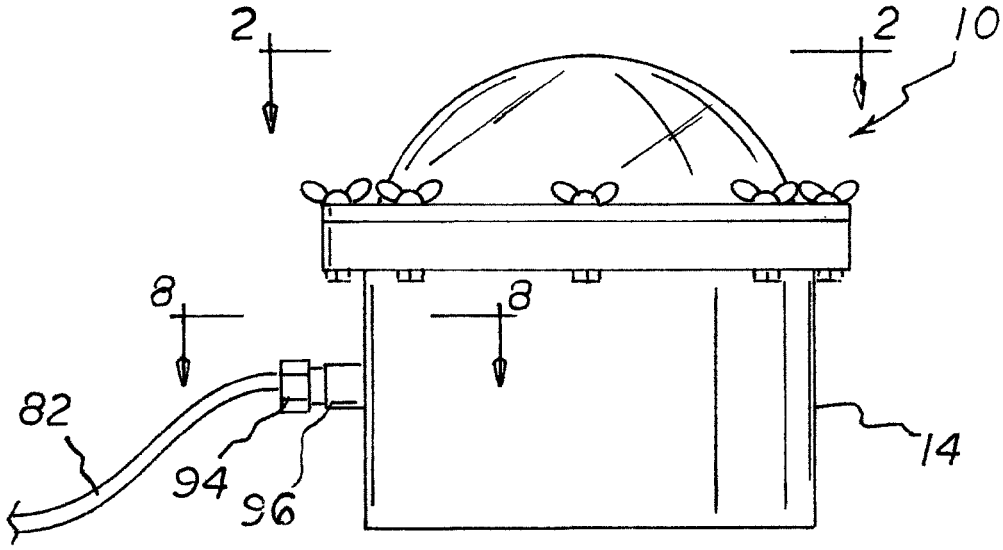
FIG. 1 is a side elevational view of the underwater components of an underwater lamp system constructed in accordance with the principles of the present invention.
Figure 2:
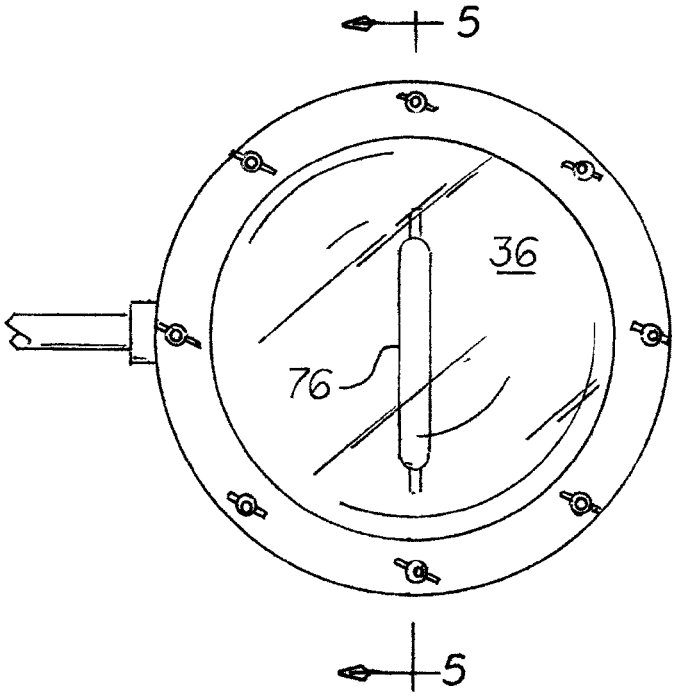
FIG. 2 is a plan view of the system taken along line 2-2 of FIG. 1.
Figure 6:
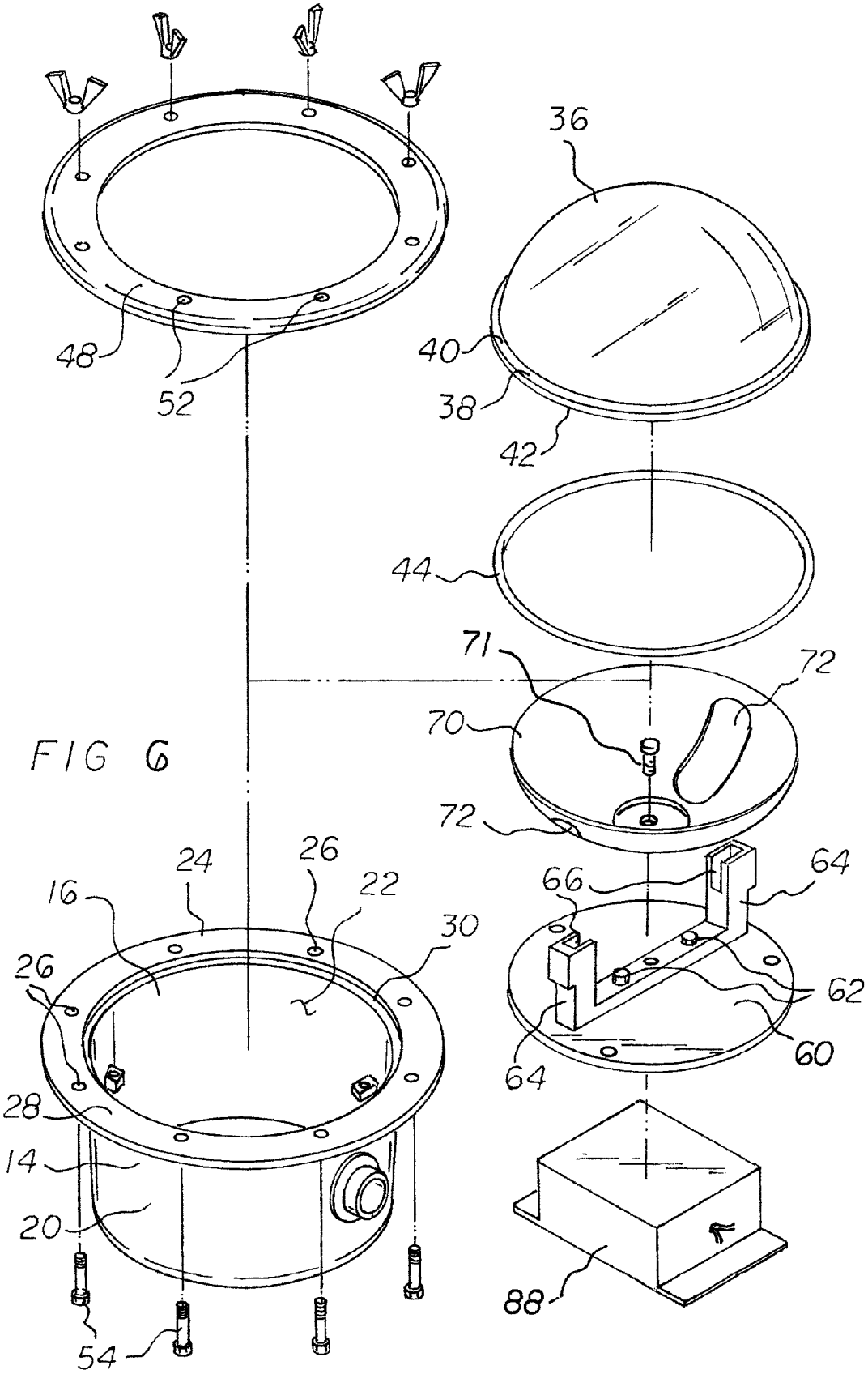
FIG. 6 is an exploded perspective view of an underwater components of the prior Figures.

With reference now to the drawings, and in particular to FIG. 1 thereof, the preferred embodiment of the new and improved underwater lighting system embodying the principles and concepts of the present invention and generally designated by the reference numeral 10 will be described.

The present invention, the underwater lighting system 10 is comprised of a plurality of components. Such components in their broadest context include an underwater housing with a lens, a reflector, a bulb and an electrical ballast. Such components also include above ground electrical components. Such components are individually configured and correlated with respect to each other so as to attain the desired objective.

First provided is a housing 14. The housing has a circular open top 16. The housing has a circular closed bottom 18. The housing has a cylindrical side wall 20. The side wall is provided between the top and the bottom. The housing forms a chamber 22. The chamber is provided interiorly. The housing includes an annular lower flange 24. The lower flange extends radially outwardly from the top. The lower flange has eight holes 26. The holes are equally spaced around the circumference of the lower flange. The lower flange has an upper face 28. The upper face terminates interiorly at the chamber and externally at the lower flange. The upper face has an annular recess 30. The recess is provided around the entire upper face. The housing is molded of an elastomeric material. The elastomeric material is selected from the class of elastomeric materials. The class of elastomeric materials includes plastic and rubber, natural and synthetic, and blends thereof. The housing has small spherical lead weights 90. The weights are positioned in the bottom of the housing. In this manner the weight of the housing is increased for submersing purposes when beneath the water.

A lens 36 is provided. The lens is in an upwardly extending hemispherical configuration. The lens has an annular upper flange 38. The lens has an upper face 40. The lens has a lower face 42. The lower face of the lens is in mating contact with the upper face of the lower flange. An O-ring 44 is provided. The O-ring is received within the recess between the faces. The lens is fabricated of a transparent material. The transparent material is selected from the class of transparent materials. The class of transparent materials includes glass and plastic.

Provided next is a pressure ring 48. The pressure ring is in an annular configuration. The pressure ring has an upper face. The pressure ring has a lower face. The lower face of the pressure ring is in contact with the lower flange of the housing. The upper flange of the pressure ring has eight holes 52. The holes are equally spaced around the circumference of the pressure ring. The holes are aligned with the holes of the lower flange. Bolts 54 are provided. The bolts extend through the holes of the lower flange and pressure ring. Wing nuts are provided. The wing nuts facilitate coupling.

A socket assembly 58 is provided within the housing. The socket assembly is provided within the chamber at an intermediate elevation. The socket assembly includes a base 60. Bolts 62 are provided. The bolts secure the base. The socket assembly also includes projections 64. The projections terminate in spaced light sockets 66. The projections terminate at an elevation adjacent to the top of the housing.

A reflector 70 is provided next. The reflector is in a downwardly extending hemispherical configuration within the chamber. The reflector is coupled to the socket assembly by a central bolt 71. The reflector has spaced apertures 72. In this manner passage of the light sockets through the reflector is allowed.

Further provided is an elongated metal halide bulb 76. The bulb has opposed ends. The bulb is removably received within the light sockets of the socket assembly. The bulb is adapted to be replaced without contacting the reflector.

Provided next is the electrical ballast with laterally extending ledges located on the bottom of the housing. Small spherical weights are poured into the housing on the ledges of the electrical ballast to hold down the electrical ballast and the entire housing underwater.

Provided last are electrical components. The electrical components include a control station 80. The electrical components include wires 82. The wires have upper ends. The upper ends of the wires are coupled to the control station. The wires have lower ends. The lower ends of the wires are coupled to the electrical ballast and the light sockets. Split rings 83 with ties are coupled to the wire between the upper and lower ends to abate floating of the wire. The control station has a ground fault circuit interrupter 84, a dock electrical outlet 86, a timer 90 and a light sensor 92. The lower end of the wires has a compression washer 94 and an O-ring 96. In this manner the wire may be coupled to the housing.

The preferred source of illumination is a lamp which emits UV-A in the range of ultra violet light between 320 and 400 nanometers and designed to peak at 360 nanometers. Such light has been shown to stimulate retinal reactivity in non-mammalian organs. UV-A is the light spectrum region that causes pigment to darken in human and other mammalian cells but is invisible to species in that group. Primarily fish, insects and some invertebrates are able to visibly detect UV-A in nature, but some birds may have the ability, as well.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An underwater lighting system comprising:

a housing with an open top and closed bottom and with a cylindrical side wall forming a chamber interiorly and including an annular lower flange extending outwardly from the top;

a lens in an upwardly extending hemispherical configuration having an annular upper flange in mating contact with the lower flange;

a socket assembly within the chamber including a base with projections terminating in spaced light sockets;

a reflector in a downwardly extending hemispherical configuration within the chamber;

a bulb with opposed ends removably received within the light sockets; and additional components within the housing including an electrical ballast and weights holing down the electrical ballast and the entire housing.

2. The system as set forth in claim 1 wherein the bulb is at an elevation adjacent to the top of the housing.

3. The system as set forth in claim 1 wherein the bulb is a metal halide bulb.

4. The system as set forth in claim 1 and further including an electrical control assembly having a ground fault circuit interrupter, a dock electrical outlet, a light sensor and a timer.

5. The system as set forth in claim 1 and further including electrical wires having an upper end at the electrical control assembly and a lower end at the housing, wherein the lower end of the wires has a compression washer and an O-ring for coupling the wire to the housing.

6. The system as set forth in claim 1 and further including split rings with ties coupled to the wire between the upper and lower ends to abate floating of the wire.

7. The system as set forth in claim 1 wherein the lamp provides a source of illumination which emits UV-A in the range of ultra violet light between 320 and 400 nanometers and designed to peak at 360 nanometers.

8. An underwater lighting system for illuminating a large body of water in a safe, convenient and economical manner comprising, in combination:

a housing with a circular open top and a circular closed bottom with a cylindrical side wall between the top and the bottom, the housing forming a chamber interiorly and including an annular lower flange extending radially outwardly from the top with a plurality of holes equally spaced around the circumference of the lower flange, the lower flange having an upper face terminating interiorly at the chamber and externally at the lower flange with an annular recess around the entire upper face, the housing being molded of an elastomeric material selected from the class of elastomeric materials including plastic and rubber, natural and synthetic, and blends thereof, small spherical lead weights positioned in the bottom to increase the weight of the housing for submersing purposes during use;

a lens in an upwardly extending hemispherical configuration having an annular upper flange with an upper face and a lower face in mating contact with the upper face of the lower flange with an O-ring received within the recess between the upper and lower flanges, the lens being fabricated of a transparent material selected from the class of transparent materials including glass and plastic;

a pressure ring in an annular configuration with an upper face and a lower face in contact with the lower flange of the housing and the upper flange of the lens with a plurality of holes equally spaced around the circumference of the pressure ring aligned with the holes of the lower flange, bolts extending through the holes of the lower flange and pressure ring with wing nuts to facilitate coupling;

a socket assembly within the chamber including a base positioned located at an intermediate elevation and secured with bolts and also including projections terminating in spaced light sockets at an elevation adjacent to the top of the housing;

a reflector in a downwardly extending hemispherical configuration within the chamber, the reflector coupled by a central bolt to the socket assembly with spaced apertures for the passage of the light sockets through the reflector, the electrical ballast being located below the reflector, the electrical ballast having laterally extending ledges located on the bottom of the housing, the small spherical weights being in the housing on the ledges of the electrical ballast to hold down the electrical ballast and the entire housing underwater during use;

an elongated metal halide bulb with opposed ends removably received within the light sockets of the socket assembly, the bulb adapted to be replaced without contacting the reflector; and electrical components including a control station and wires with upper ends coupled to the control station and with lower ends coupled to the electrical ballast and the light sockets, split rings with ties coupled to the wire between the upper and lower ends to abate floating of the wire, the control station having a ground fault circuit interrupter, a dock electrical outlet, a timer and a light sensor, additional components within the housing including an electrical ballast and weights holing down the electrical ballast and the entire housing, the lower end having a compression washer and an O-ring for coupling the wire to the housing, the lamp providing a source of illumination which emits UV-A in the range of ultra violet light between 320 and 400 nanometers and designed to peak at 360 nanometers.

* * * * *